United States Patent [19]

Oberstein et al.

[11] Patent Number: 4,514,720

[45] Date of Patent: Apr. 30, 1985

[54] METHOD AND APPARATUS FOR INCREASING THE RESPONSE SENSITIVITY AND THE INTERFERENCE RESISTANCE IN AN ALARM SYSTEM

[75] Inventors: Karla Oberstein; Peer Thilo, both of Munich, Fed. Rep. of Germany

[73] Assignee: Siemens Aktiengesellschaft, Berlin & Munich, Fed. Rep. of Germany

[21] Appl. No.: 375,316

[22] Filed: May 5, 1982

[30] Foreign Application Priority Data

Jul. 10, 1981 [DE] Fed. Rep. of Germany ..... 3127324

[51] Int. Cl.[3] ..... G08B 29/00

[52] U.S. Cl. ..... 340/511; 340/506; 340/518; 340/537; 340/657; 340/661

[58] Field of Search ..... 340/511, 506, 500, 501, 340/507-510, 512, 517, 518, 521-526, 531, 532, 657, 537, 660-664, 870.01, 870.09, 870.16, 870.17, 825.09-825.13; 307/358; 328/162

[56] References Cited

U.S. PATENT DOCUMENTS

| | | | |
|---|---|---|---|
| 4,222,041 | 9/1980 | Von Tomkewitsch et al. | 340/505 |
| 4,283,717 | 8/1981 | Caldwell et al. | 340/511 |
| 4,313,114 | 1/1982 | Lee et al. | 340/870.23 |

*Primary Examiner*—Donnie L. Crosland

*Attorney, Agent, or Firm*—Hill, Van Santen, Steadman & Simpson

[57] ABSTRACT

A method and apparatus for increasing the response sensitivity and the interference resistance in an alarm system such as a fire alarm system which cyclically samples a plurality of alarm units in the system for obtaining a series of measured values from each alarm unit, the measured values being utilized to form a quiescent value which is stored in a quiescent value memory. With each sampling cycle a current comparison value is formed from the alarm measured value, the stored quiescent value, and a comparison value from a previous sampling cycle stored in a comparison value memory. The current comparison value is then written in the comparison value memory as the new comparison value. The current comparison value is compared with a rated limiting value, and if the comparison value is greater than or equal to the rated limiting value, a display unit is activated indicating an alarm. If the comparison value is less than the rated limiting value, a new quiescent value is formed from the measured value and the stored quiescent value and written into the quiescent value memory.

9 Claims, 6 Drawing Figures

METHOD AND APPARATUS FOR INCREASING THE RESPONSE SENSITIVITY AND THE INTERFERENCE RESISTANCE IN AN ALARM SYSTEM

BACKGROUND OF THE INVENTION

1. Field of the Invention

The present invention relates to methods and devices for operating a danger alarm system, such as a fire alarm system, and in particular to a method and apparatus for increasing the response sensitivity of the alarm units in the alarm system while also increasing the interference resistance of the alarm units.

2. Description of the Prior Art

Automatic alarm systems such as fire alarm systems generally consist of a plurality of alarm units connected to a central station which each continuously emit alarm measured values which are cyclically sampled and evaluated at the central station. The alarm units in alarm systems such as fire alarm systems monitor a number of parameters such as smoke density, temperature, and radiation which are each weighted and evaluated in order to trigger an alarm signal. Each alarm unit has a characteristic interference resistance which is the ability of an alarm unit to "ignore" the various danger parameters until those parameters individually and/or in combination reach danger levels thus in theory preventing false alarms. Each alarm unit may, for example, contain a threshold circuit dedicated to each monitored parameter which emits an alarm signal to the central station whenever the threshold is exceeded. In order to increase the interference resistance, and thus further minimize the possibility of false alarms, the central station may contain timing circuits which indicate an alarm only when the threshold of one or more threshold circuits has been exceeded for a specified length of time. Such absolute threshold circuits may be employed in combination with threshold circuits which monitor the change over a period of time of a selected parameter, with a rate of change above a selected rate triggering an alarm. A competing design goal in alarm systems is that of designing an alarm system with a high response sensitivity, which is the ability of the alarm system to trigger an alarm signal every time true alarm conditions exist. The interference resistance of an alarm unit cannot be made so high as to significantly decrease the response sensitivity, otherwise true alarm conditions may fail to trigger an alarm signal.

A problem affecting both the interference resistance the the response sensitivity of alarm units is that of changing electronic component values associated with the electronic components comprising an alarm unit due to aging, dirt, humidity and the like. An evaluation threshold which may be set at the time of installation of an alarm unit may be satisfactory at the time of installation but, as a result of changing component values over a period of time, may no longer be acceptable and may trigger false alarms or cause true alarm conditions to fail to trigger an alarm.

SUMMARY OF THE INVENTION

It is an object of the present invention to provide an alarm system which has a high response sensitivity and a high interference resistance which will reliably operate over a very long period of time.

It is a further object of the present invention to provide such an alarm system in which aging of the components and soiling of the alarm units has no significant influence on the response sensitivity of the alarm units.

The above objects are inventively achieved in an alarm system having a plurality of alarm units connected to a central station which constantly emit measured values which are cyclically sampled at the central station and from which a mean alarm measured value is formed and utilized as the alarm quiescent value, which is stored in a quiescent value memory. The difference between a current alarm measured value and the stored quiescent value is calculated and the difference is utilized for deriving a comparison value, which is stored in a comparison value memory. The comparison value is compared with a rated limiting value and, upon exceeding that value, activates a display device indicating alarm conditions.

In accordance with the above method, a mean alarm measured value is formed for each alarm unit. This value, which is utilized as the alarm quiescent value, is derived from the preceding alarm measured values. Upon each sampling cycle for each alarm, the difference between the current measured value received from the alarm unit and the most recently stored quiescent value is formed. These differences are utilized to form the current comparison value which is stored in a comparison value memory which is similarly updated with each sampling cycle. This current comparison value is compared in a comparison device with a rated limiting value. If the current comparison value is less than the limiting value, a new quiescent value is formed from the current alarm measured value and the stored quiescent value. This new quiescent value is stored in the quiescent value memory for use in the next sampling cycle. If the current comparison value is equal to or greater than the limiting value, the display device is actuated by the comparison device for indicating alarm conditions.

The use of the individually transmitted alarm measured values from each alarm unit to form a quiescent value for the alarm unit permits a new quiescent value to be formed for each alarm unit, for example, upon switching-on of the system or to meet individual conditions, such as during inspection or maintenance. The formation of new quiescent values will take place with a relatively large time constant of, for example, one day.

Instead of evaluating the measured value in absolute terms as in conventional systems, the inventive method and apparatus make use of the difference between the alarm measured value and the quiescent value in order to trigger subsequent events. This difference is constantly updated in intervals of, for example, several seconds or with each sampling cycle and is weighted and evaluated in accordance with its magnitude. A comparison value is preferably derived from these differences which, upon exceeding a fixed limiting value, activates the display device.

The current comparison value is calculated by the difference of the current measured value and the stored quiescent value from which the stored comparison value is then subtracted. This result is then further reduced by a constant value in order that smaller measured value fluctuations which are below the constant value do not result in the activation of a display. This result is then integrated to form a sum signal, that is, the result is added to the last-stored comparison value. This sum signal is utilized as the current comparison value. In order to establish a lower limit, this comparison value is compared in a comparator with zero and if the comparison value is greater than zero the comparison value is then stored in the comparison value memory for use in the next sampling cycle. If the comparison value is less than zero, the contents of the comparison value memory are set to zero.

The alarm quiescent value is formed from the alarm measured values and is stored in a memory whereby during a first sampling cycle the first alarm measured value corresponds to the quiescent value. The time constant utilized in forming the quiescent value can be varied by varying a parameter between zero and one by which the measured value and quiescent value are multiplied.

DESCRIPTION OF THE PREFERRED EMBODIMENTS

Figure 1A:
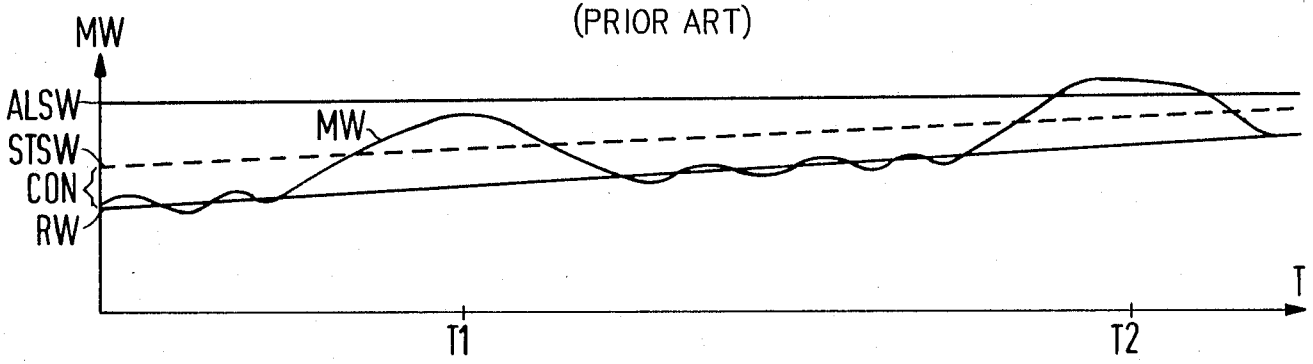
FIG 1a (PRIOR ART)
FIG. 1*a* is a graphic representation of the response of a conventional alarm unit over a first type of aging conditions.
Figure 1B:
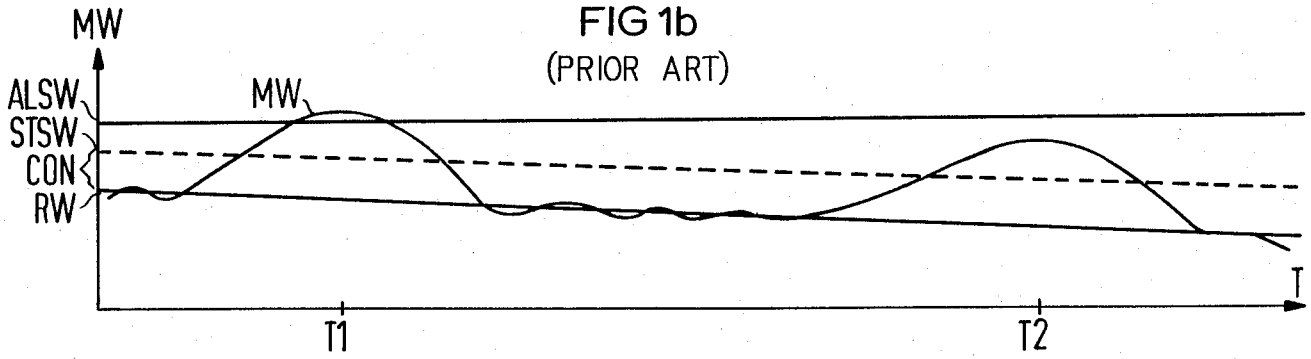
FIG 1b (PRIOR ART)
FIG. 1*b* is a graphic representation of the response of a conventional alarm unit over a second type of aging conditions.

The deteriorating operation of a conventional alarm unit under two different types of operating conditions is respectively shown in FIG. 1*a* and FIG. 1*b*. In each of those figures, measured values MW received from the alarm unit are plotted on the vertical axis with respect to time T shown on the horizontal axis. Such an alarm unit has an alarm threshold ALSW which is parallel to the time axis. The alarm unit has a quiescent value which is theoretically shown as a line RW which rises slightly with respect to time in FIG. 1*a* and which decreases slightly with respect to time in FIG. 1*b*. In each figure an interference threshold STSW is shown which is parallel to the theoretical quiescent value RW at a constant interval CON therefrom. Under the conditions shown in FIG. 1, the alarm measured value MW becomes considerably enlarged at approximately the time T1 as compared with the quiescent value RW. This increase in the measured value MW, however, is not sufficiently large so as to reach the alarm threshold ALSW, and thus an alarm signal is not displayed by the system. Given the continued rise of the theoretical quiescent value RW due to the aging of components, a similar event occurring at approximately the time T2 would erroneously generate an alarm signal. The alarm operating in accordance with FIG. 1*a* has thus automatically become more sensitive over time. The increase in the measured value MW at the time T2, which is not greater than at the time T1, exceeds the alarm threshold ALSW at the time T2, so that a false alarm occurs.

In FIG. 1*b* the theoretical quiescent value RW is shown to be steadily decreasing as a result of component aging. Under these conditions, the alarm unit automatically becomes less sensitive in the course of time. Under these conditions, the measured value MW becomes enlarged at a time T1 sufficiently so as to exceed the alarm threshold ALSW, therefore triggering an alarm signal. The same event occurring later at the time T2, as a result of the decreasing theoretical quiescent value RW, does not exceed the alarm threshold value ALSW, and therefore no alarm signal occurs. In a conventional alarm system at the time T2, therefore, alarm conditions are no longer recognized because the theoretical quiescent value RW has decreased and therefore danger conditions may exist which do not trigger an alarm signal. The manner of operation of an alarm system operating in accordance with the principles of the present invention, which avoids the problems of the conventional systems whose operation is shown in FIGS. 1*a* and 1*b*, is graphically represented in FIG. 2, wherein the upper graph again shows the relation between the measured value MW on the vertical axis and time T on the horizontal axis and the lower graph shows the relationship between a sum signal, the calculation of which is described in greater detail below with respect to time T. Again, the threshold value of the alarm unit is shown at ALSW and the interference resistance value for the alarm unit is shown at STSW. The quiescent value RW is shown coincident with the T axis. A rated limiting value GRW is also shown in the lower graph in FIG. 2 parallel to the T axis.

Figure 2:
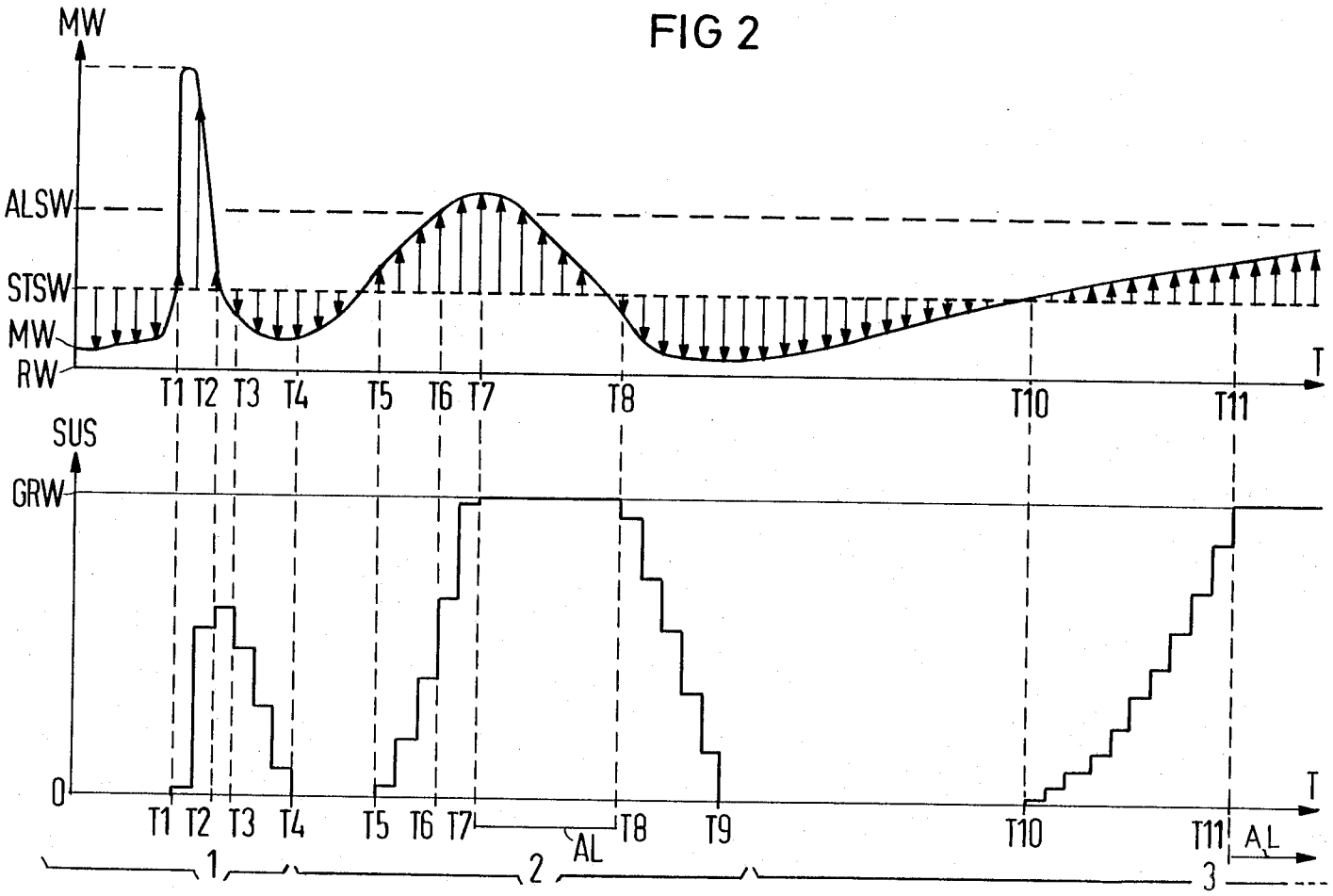
FIG. 2 is a graphic representation showing the operation of the method and apparatus disclosed herein under three types of events.

Each arrow shown in FIG. 2 represents a sampling cycle at which time the magnitude of the alarm measured value is evaluated and a stored quiescent value is subtracted therefrom. This difference is thus constantly updated with each sampling cycle. The difference is compared to a fixed value, the interference threshold STSW, so that smaller measured value fluctuations, which are below the interference threshold STSW, do not add over a period of time in order to generate a false alarm signal.

The sum signal SUS shown in the lower graph in FIG. 2 causes an alarm signal to be generated upon reaching or exceeding the rated limiting value GRW. The response of the system disclosed and claimed herein to three types of events is shown in FIG. 2. The first event 1 is that of the measured value MW suddenly rising at a time T1 beyond the alarm threshold value ALSW and quickly falling below the threshold ALSW at a time T2. In conventional alarm systems of the type described earlier, this event would trigger an alarm signal unless a further check were undertaken such as, for example, to determine the period of time over which the measured value MW exceeds the threshold value ALSW. The operation of the system constructed in accordance with the principles of the present invention, however, is such that the manner in which the sum signal SUS is calculated causes no rise of the sum signal SUS beyond the rated limiting value GRW, so that no alarm signal occurs. At the time T2 the alarm measured value MW falls below the interference threshold STSW which, during the formation of the sum signal SUS, has as a consequence the measured value MW entering into the calculation as a negative value. In order to prevent an increasing integration of the sum signal SUS in the negative range, as described in greater detail below, a comparison value is formed by a comparison with zero, so that the sum signal SUS never falls below zero. This is shown for the interval beginning at T4.

A second event 2 is shown in FIG. 2 whereby beginning at time T5 the sum signal again becomes positively integrated and at the time T6 the alarm measured value MW reaches the alarm threshold ALSW. The sum signal SUS is at this time not yet positively integrated to the rated limiting value GRW and only at the time T7 does the sum signal SUS attain the rated limiting value GRW causing an alarm actuation AL until the Time T8. Thus, in accordance with the inventive method and apparatus, an alarm signal occurs only if the alarm measured value satisfies the dual conditions of being of a sufficient magnitude and existing for a sufficient length of time.

The occurrence of a third event 3 is shown in FIG. 2 which is characterized by a slow rise of the alarm measured value MW in the direction of the alarm threshold ALSW. A conventional alarm system would not yet recognize alarm conditions because the measured value MW at the time T11 has not yet attained the alarm threshold ALSW. In accordance with the inventive method and apparatus, however, the alarm measured value is compared to the quiescent value at each sampling period after it has exceeded the interference threshold STSW and therefore the sum signal SUS reaches the rated limiting value GRW at the time T11 and results in an alarm signal AL. Thus, in accordance with the principles of the present invention, a constant rise of the alarm measured value MW in the direction of the alarm threshold value ALSW is recognized early as being characteristic of an alarm condition and therefore triggers an alarm signal at an earlier time than conventional systems.

Figure 3:
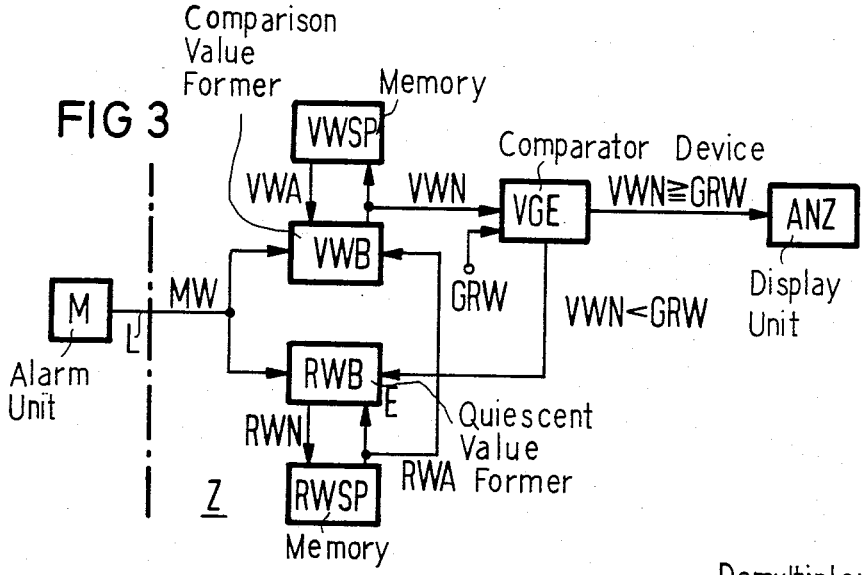
FIG. 3 is a block diagram schematically showing a portion of an alarm system constructed in accordance with the principles of the present invention having high interference resistance and high response sensitivity.

A block diagram showing an embodiment of a portion of an alarm system constructed in accordance with the principles of the present invention is shown in FIG. 3. Although only one alarm unit M and one alarm line L associated therewith are shown in FIG. 3 it will be understood that the actual alarm system will contain a plurality of such alarm units and alarm lines. All elements to the right of the dot and dash line in FIG. 3 are located at a central station Z. It will be understood that the elements shown at the central station Z may be portions of larger components, such as a microcomputer, which service the entire alarm system and which includes a means for cyclically sampling each alarm unit M.

Upon each sampling period, a measured value MW from an alarm unit M is transmitted via the alarm line L to a comparison value former VWB and a quiescent value former RWB at the central station Z. The comparison value former is connected to a memory VWSP in which the current comparison value VWN is stored. Similarly, a memory RWSP is connected to the quiescent value former RWB in which the current quiescent value RWN is stored. Upon each sampling cycle, for each alarm, the comparison value former VWB forms a new or current comparison value from the measured value MW and the last-stored comparison value VWA. This current comparison value VWN is then stored for use in the next sampling cycle in the memory VWSP, and is also compared with a rated limiting value GRW in a comparison device VGE. If the current comparison value VWN is greater than or equal to the rated limiting value GRW, an alarm signal is generated which activates an appropriate display via a display unit ANZ. If the current comparison value VWN does not exceed the rated limiting value GRW, the alarm measured value MW, with the old quiescent value RWA from the memory RWSP are utilized for calculating a new quiescent value RWN, which is then written into the memory RWSP to replace the old quiescent value. The conditions shown in the block diagram of FIG. 3 illustrate the recognition of alarm conditions. In a similar fashion it is also possible to recognize interference conditions and to display such conditions.

Figure 4:
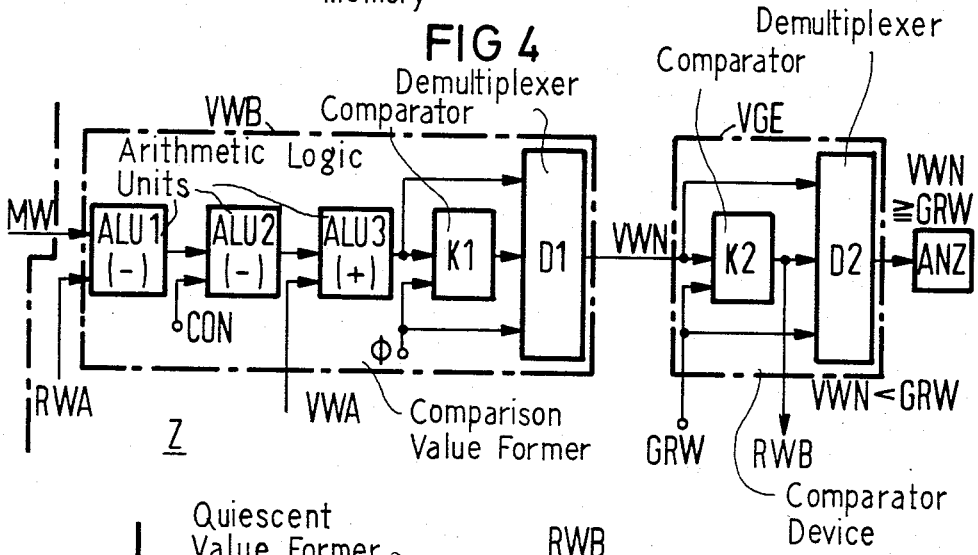
FIG. 4 is a block diagram of a portion of the device shown in FIG. 3 showing the comparison value former and the comparator device in detail.

The components comprising the comparison value former VWB are shown in greater detail in FIG. 4 together with the components comprising the comparator device VGE.

The alarm measured value MW is first received in the comparison value former VWB by an arithmetic logic unit AL1 which subtracts the old quiescent.value RWA from the memory RWSP from the measured value MW. The result of this subtraction is then transmitted to a second arithmetic logic unit ALU2 which subtracts a constant value CON from the output of ALU1. The result of this second subtraction is then transmitted to a third arithmetic logic unit ALU3 in which the output of ALU2 is added to the last stored comparison value VWA. The output of the third arithmetic logic unit ALU3 is supplied to a comparator K1 in which the output of the third arithmetic logic unit ALU3 is compared with zero. If the output of the third arithmetic logic unit ALU3 is greater than zero, the comparator supplies a signal to a demultiplexer D1 so that the output of the third arithmetic logic unit ALU3 is utilized as the current comparison value VWN. If the output of the arithmetic logic unit ALU3 is less than zero, the demultiplexer transmits zero as the current comparison value VWN. The comparison value VWN is the same as the sum signal SUS shown in FIG. 2.

The current comparison value VWN is supplied to the comparison device VGE which includes a comparator K2 in which the current comparison value VWN is compared with the rated limiting value GRW. If the current comparison value VWN is greater than the rated limiting value GRW, the comparator K2 supplies a signal to a demultiplexer D2 for activating the display device indicating alarm conditions. If the current comparison value VWN is less than the rated limiting value GRW, a signal is supplied to the quiescent value former RWB for enabling the quiescent value former RWB to form a new quiescent value RWN, as described in greater detail in connection with FIG. 5.

Figure 5:
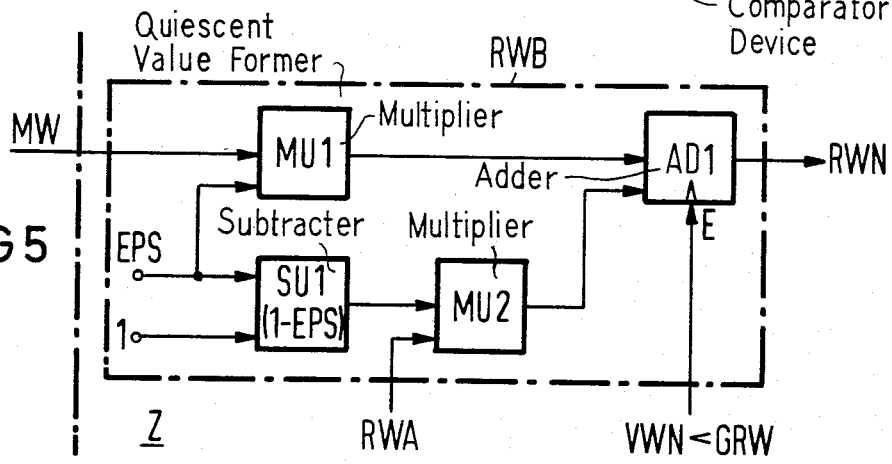
FIG. 5 is a block diagram of a portion of the device shown in FIG. 3 showing the quiescent value former in detail.

As shown in FIG. 5, the quiescent value former RWB has a first multiplier MU1 connected in series to a first input of an adder AD1. The quiescent value former RWB also contains a subtracter SU1 which has one input supplied with a constant "1" value and another input which is supplied with a value EPS which can be varied between zero and one. By varying the value EPS the weight of the difference between the measured value MW and the last-stored quiescent value RWA utilized in the formation of the new quiescent value RWN can be varied. The value EPS is also supplied to an input of the multiplier MU1. The output signal (1−EPS) of the subtracter SU1 is supplied to a second multiplier MU2, to which the last-stored quiescent value RWA from the memory RWSP is also supplied. The output of the second multiplier MU2 is connected to the second input of the adder AD1. The adder AD1 is enabled by a signal at an enabling input E whenever the result of the comparison undertaken in the comparator VGE shows the current comparison value VWN to be less than the rated limiting value GRW. The current alarm value MU is multiplied in the first multiplier MU1 with the value EPS and the old quiescent value RWA from the memory RWSP is multiplied in the second multiplier MU2 with the value (1−EPS). These two products are then added in the adder AD1, when suitably enabled, the output of which is the new quiescent value RWN.

With the inventive method, the slow changing of the interference resistance of an alarm unit can be compensated for by changing the value EPS. The sensitivity of the alarm unit, however, remains constant over a very long period of time so that different types of uses can generally be services with uniform alarms and evaluation programs. Additionally, slowly developing fires as well as rapidly spreading fires are recognized at the earliest possible moment, while false alarms are substantially eliminated.

Although modifications and changes may be suggested by those skilled in the art it is the intention of the inventors to embody within the patent warranted hereon all changes and modifications as reasonably and properly come within the scope of their contribution to the art.

We claim as our invention:

1. A method for operating a danger alarm system for increasing the response sensitivity and the interference resistance of the alarm system, said alarm system having a plurality of alarm units connected via a plurality of alarm lines to a central station, each of said alarm units continuously emitting measured values representing conditions monitored by said alarm units, said measured values being cyclically sampled at said central station, said method comprising for each alarm unit the steps of:

forming an alarm quiescent value from each sampled measured value emitted by an alarm unit;

subtracting a quiescent value formed from a measured value sampled immediately preceding a current measured value from said current measured value;

forming a current comparison value from the difference resulting from said subtraction;

storing said current comparison value;

comparing said current comparison value with a rated limiting value;

activating a display means for displaying an alarm if said current comparison value is greater than or equal to said rated limiting value; and updating a quiescent value memory by replacing said quiescent value formed from said measured value sampled immediately preceding said current measured value with a quiescent value formed from said current measured value if said current comparison value is less than said rated limiting value.

2. The method of claim 1 wherein said step of forming said current comparison value comprises the steps of:

forming a reduced difference by reducing said difference by a selected constant amount;

forming a sum signal by adding said reduced difference to a comparison value formed from said measured value sampled immediately preceding said current measured value, said sum signal being set to zero during a first sampling cycle; and comparing said sum signal to zero and utilizing said sum signal as said current comparison value if said sum signal is greater than zero and utilizing zero as said current comparison value if said sum signal is less than zero.

3. The method of claim 1 wherein said step of forming said alarm quiescent value comprises the steps of:

forming a first product by multiplying said current measured value by a first selected constant which is greater than zero and less than one;

forming a second product by multiplying the contents of said quiescent value memory by a second selected constant;

adding said first and second products and replacing said contents of said quiescent value memory with the sum of said first and second products if said current comparison value is less than said rated limiting value.

4. The method of claim 3 wherein said second selected constant is formed by subtracting said first selected constant from one.

5. In a danger alarm system having a plurality of alarm units connected to a central station by a plurality of alarm lines, each alarm unit continuously emitting measured values corresponding to the conditions monitored by said alarm units and a means at said central station for cyclically sampling said measured values, the improvement of a means for increasing the response sensitivity and the interference resistance of said alarm system, said means being located at said central station and comprising:

a quiescent value former connected to an alarm line for an alarm unit for forming a quiescent value from each sampled measured value emitted by said alarm unit;

a quiescent value memory connected to said quiescent value former for storing said quiescent values therein;

a comparison value former connected to said alarm line for said alarm unit and to said quiescent value memory for forming a current comparison value from a current measured value and a quiescent value formed from a measured value sampled immediately preceding said current measured value;

a comparison value memory connected to said comparison value former for storing said comparison values therein;

a comparator device connected to said comparison value memory and to said quiescent value former, said comparator device comparing said current comparison value with a rated limiting value; and a display means connected to said comparator device, said comparator means activating said display means for displaying an alarm signal if said current comparison value is greater than or equal to said rated limiting value, and said comparator device enabling transfer of a quiescent value from said quiescent value former which was formed from said current measured value to said quiescent value memory for updating said quiescent value memory if said current comparison value is less than said rated limiting value.

6. The improvement of claim 5 wherein said comparison value former comprises:

a first arithmetic unit for subtracting the contents of said quiescent value memory from said current measured value;

a second arithmetic logic unit connected to said first arithmetic logic unit for subtracting a constant value from the output of said first arithmetic logic unit;

a third arithmetic logic unit connected to said second arithmetic logic unit for adding the contents of said comparison value memory to the output of said second arithmetic logic unit;

a comparator connected to said third arithmetic logic unit for comparing the output of said third arithmetic logic unit with zero; and a demultiplexer having an input connected to said output of said third arithmetic logic unit and an input connected to an output of said comparator and having an output connected to said comparator device, said demultiplexer transmitting said output of said third arithmetic logic unit to said comparator device as said current comparison value if said output of said third arithmetic logic unit is greater than zero, and said demultiplexer transmitting zero as said current comparison value if said output of said third arithmetic logic unit is less than zero.

7. The improvement of claim 5 wherein said quiescent value former comprises:

a first multiplier for multiplying said current measured value by a first selected constant which is greater than zero and less than one;

a second multiplier for multiplying the contents of said quiescent value memory by a second selected constant value; and an adder connected to the outputs of said first and second multipliers for adding the products formed by said first and second multipliers, said adder having an enabling input connected to said comparator device and having an output connected to said quiescent value memory, whereby the output of said adder is supplied to said quiescent value memory for updating the contents thereof upon receipt of an enabling signal from said comparator device when said current comparison value is less than said rated limiting value.

8. The improvement of claim 7 wherein said quiescent value former further comprises a means for generating said second selected constant as a function of said first selected constant.

9. The improvement of claim 8 wherein said means for generating said second selected constant is a subtracter having an output connected to said second multiplier for subtracting said first selected constant from one.

* * * * *